United States Patent [19]

Kaufmann et al.

[11] 4,202,792

[45] May 13, 1980

[54] METHOD FOR NONCONTAMINATING SOLIDIFICATION OF RADIOACTIVE WASTE MATERIALS

[75] Inventors: Friedrich Kaufmann, Karlsruhe; Siegfried Weisenburger, Au/Rhein; Herbert Koschorke, Stutensee-Friedrichstal; Hartmut Seiffert, Karlsruhe; Dieter Sienel, Karlsruhe; Karl-Heinz Weiss, Karlsruhe, all of Fed. Rep. of Germany

[73] Assignee: Gesellschaft fur Kernforschung m.b.H., Karlsruhe, Fed. Rep. of Germany

[21] Appl. No.: 862,048

[22] Filed: Dec. 19, 1977

[30] Foreign Application Priority Data

Dec. 17, 1976 [DE] Fed. Rep. of Germany ..... 2657265

[51] Int. Cl.[2] ..... G21F 9/08; G21F 9/14; G21F 9/16

[52] U.S. Cl. ..... 252/301.1 W; 106/54

[58] Field of Search ..... 252/301.1 W; 106/54

[56] References Cited

U.S. PATENT DOCUMENTS

| | | | |
|---|---|---|---|
| 3,153,566 | 10/1964 | Spector | 252/301.1 W |
| 3,673,086 | 6/1972 | Drobnik | 252/301.1 W |

FOREIGN PATENT DOCUMENTS 1421219 1/1976 United Kingdom .

OTHER PUBLICATIONS

Krause, H., "Die Verfestigung hochradioaktiver Abfalle", *Chemie-Ing.-Techn.*, 45 (10a), May 1973, pp. 658–663.

Grover, J. R. et al., "The FINGAL Process", AERE-R5188, Mar. 1966, pp. 1–6, 10, 11 and FIG. 1.

Morris, J. B. et al., "Preliminary Experience With the New Vitrification Inactive Pilot Plant", Int'l. Symp. on the Mgmt. of Rad. Wastes from the Nuc. Fuel Cycle, Vienna, (Paper IAEA/SM/207/22), Mar. 1976, pp. 1–9, Tables 1–7 and FIGS. 1–5.

Laude, F., "Pot Vitrification of Concentrated Fission Product Solutions", CONF-660208, Nov. 1966, pp. 222–234.

Johnson, K. D. B. et al., "Work in the U.K. on fixation of highly radioactive wastes in glass", Proc. 3rd Int'l. Conf. on Peaceful Uses of Atomic Energy, Geneva, Sep. 1964, vol. 14, pp. 244–252.

*Primary Examiner*—Benjamin R. Padgett
*Assistant Examiner*—Deborah L. Kyle
*Attorney, Agent, or Firm*—Spencer & Kaye

[57] ABSTRACT

Method for the solidification, in a manner which protects the environment against contamination, of waste materials obtained during reprocessing of irradiated nuclear fuel and/or breeder materials in a matrix of borosilicate glass. Highly radioactive solutions or slurries containing the waste materials in dissolved or suspended form are evaporated in a vessel in the presence of glass former substances until they are dry, the dry residue is calcinated and the calcinate is melted together with the glass formers while the waste gases are discharged to the environment. The waste liquid is obtained from a reprocessing system without pretreatment, is mixed with glass formers and a reduction agent and then is introduced in a controlled, continuous manner into the center of a borosilicate glass melt disposed in a melting crucible at a temperature in the region of 1000° to 1400° C. to form an island-like drying and calcinating zone on the surface of the melt while avoiding contact of the waste liquid with the walls of the crucible. A reducing atmosphere is formed and the presence of components in the waste gas which would radiologically and/or chemically contaminate the environment are substantially avoided.

7 Claims, No Drawings

METHOD FOR NONCONTAMINATING SOLIDIFICATION OF RADIOACTIVE WASTE MATERIALS

BACKGROUND OF THE INVENTION

The present invention relates to a method for the solidification, in a manner which protects the environment against contamination, of waste materials obtained during reprocessing of irradiated nuclear fuel and/or breeder materials in a matrix of a borosilicate glass type, in which highly radioactive solutions or slurries containing the waste materials in dissolved or suspended form are evaporated in a vessel in the presence of glass former substances until they are dry, the dry residue is calcinated and the calcinate is melted together with the glass formers while the waste gases are discharged to the environment.

In order to solidify highly radioactive waste materials obtained during reprocessing of irradiated nuclear fuels, it has been known for a long time to use masses of glass or a glass-like material, for example, masses of the type of a borosilicate glass or of the type of a phosphate glass. A series of articles report on experiments to evaporate aqueous radioactive solutions or slurries until they are dry, to calcinate the dry residue and to incorporate the calcinate in such matrices through melting with the addition of glass formers.

In Great Britain, for example, the FINGAL process has been developed in which the waste solution and the glass forming additives are supplied and pretreated in separate systems, and are mixed together only shortly before entrance into the process vessel in which the glass mass is produced by melting. See, J. R. Grover, W. H. Hardwick, R. Gayler, M. H. Delve: Report of the United Kingdom Atomic Energy Authority, Research Group, Nr. AERE-R-5188, 1966. The process vessel is inserted into a high temperature furnace which is divided into a plurality of separate heating zones. Two further vessels are connected with the process vessel in series, the further vessels being provided with a primary or secondary filter, respectively, for cleaning the waste gas. In order to prevent condensate formation in the vessels containing the filters, the two filter containing vessels are inserted in furnaces. These filters are provided to retain suspended matter and volatile fission products and are melted into the glass matrix when the filters become fully charged. The further components of the waste gas system are a condenser, a nitric oxide absorber in which nitric acid is recovered, a base liquor washer and an absolute filter.

For the FINGAL process, the solidification matrix can be a phosphate glass or a borosilicate glass. Incorporation of the waste material in borosilicate glass is preferred because the highly corrosive phosphate glass melt led to considerable difficulties in spite of certain good properties, such as, for example, low melting temperature and relatively good dosability of the glass formers. Due to the required limitation of the operating temperature of the glass melt to about 1100° C. in order to assure sufficient lifetime of the system components, the use of a borosilicate glass generally does not permit the incorporation of more than about 30 percent by weight waste materials or waste oxides, respectively, in the final product.

The FINGAL process itself has been described as follows: In a stirring vessel, a pumpable suspension was produced of finely ground borax, silicon dioxide and nitric acid. It has a relatively low tendency to settle. The waste solution, which was received from the reprocessing system in a pre-concentrated form, is pretreated in an additional vessel, i.e. is brought to the chemical composition required for solidification. Then, waste solution and glass formers are separately pumped into the process vessel and are mixed together shortly before they enter it. The start of the introduction of the mixture takes place at relatively low temperatures. In the process vessel, layers must form in which the following individual process steps can take place:

(1) a first layer in which there is evaporation of the water and the nitric acid, and removal of the resulting nitric oxides;

(2) a second layer in which there is calcination and possibly sintering; and (3) a third layer in which there is melting.

The pretreatment of the waste solution in an additional vessel comprises a further concentration of the pre-concentrated waste solution together with careful control of chemical composition of the mixture, including glass former additives. If necessary, additional glass former components can be added into this vessel. This pretreatment is required not only for the FINGAL process but also for the RLG process, for the continuous pot glass process, and for the Piver process, which were described in the following.

For this reason, separate heating zones must be provided in the process vessel. The lower portion of the process vessel is heated to about 1050° C. in order to melt the calcinate only after the calcinate layer has become thick enough so that no waste solution can flow through and under the calcinate which would interfere with the normal process sequence. With increasing quantities introduced and increasing masses of the glass melt, layers (1) and (2) travel upwardly. The heating energy for the separate heating zones of the high temperature furnace is selected correspondingly. When the process vessel has been filled with glass melt to about 70% of its volume, the introduction of waste solution and glass formers is terminated. The feeder line is then rinsed clean with water and the temperature of the heater in the region of the head of the vessel is increased in order to melt deposits which may have accumulated there. Then, the high temperature furnace is switched off, the process vessel is cooled with air and uncoupled from the supply lines, and removal from the high temperature melting furnace and sealed. The sealed process vessel serves as a storage vessel and can be transported to a storage location. The process is thus discontinuous, i.e. material is fed in only until the glass melt has reached 70% of the process vessel volume. Then, the first filter vessel which was immediately below the process vessel and which now contains a charged filter is introduced into the high temperature melting furnace and now serves as the new process vessel. Before the start of renewed introduction of waste solution and glass formers into the new process vessel, the vessel is heated to about 420° C. causing a solder connection, with which the filter has connected to the waste gas line, to be melted and the filter to drop to the bottom of the vessel. There, the filter will be enclosed in glass during the further process sequence.

In a process vessel of 1500 m in length and a diameter of 150 mm, an intake rate of about 4.5 liter per hour is supposed to be attainable in the FINGAL process. The times required for the process are supposed to be as follows:

heating of the process vessel to operating temperature: about 6 hours;

melting away deposits at the head of the process vessel: about 3 hours;

evaporating, calcining, and melting until the melt fills 70% of the vessel volume: about 24 to 30 hours;

cooling and normalizing period: about 20 hours.

A similar process is the rising-level-glass process (RLG) developed in the USA in which, as in the FINGAL process, the glass melt mass containing the waste substances increases in the course of the process and the individual process steps of (1) evaporating and drying, (2) calcinating, and (3) melting, take place simultaneously in delimited zones. When the aqueous phase has reached a certain level or layer thickness, respectively, in the process vessel the amount of waste solution introduced is reduced and is adapted to the existing evaporation output. The level of the aqueous phase is a very important parameter for the RLG process. On the one hand, it is to be as large as possible in order to produce a high evaporation output because it is determinative, inter alia, of the throughout efficiency of the system. On the other hand, it must not exceed a certain maximum because then the calcinate layer would break open. In that case the aqueous phase would run through the cracks in the calcinate layer and come into direct contact with the melt which may result in an interference with the normal process sequence.

In another version of the RLG process, the process vessel contains centrally arranged thermoelements which are protected by a protective pipe disposed in the center of the process vessel. The waste solution together with the glass formers is introduced into the vessel by letting the solution run down the protective pipe for the thermoelements in the form of a film, and this causes a major portion of the liquid to evaporate. The remainder of the evaporation and drying then takes place in a relatively small area around said pipe. The calcinate here forms a layer which becomes thinner radially outwardly from the protective pipe toward the wall of the vessel. This technique is intended to prevent a vary difficultly controllable process sequence which may have as a result an excess contamination of the waste gas and even clogging of the waste gas system. This mode of operation with application of the waste solution in the form of a film, is supposed to make the transition from the aqueous phase to the melt more controllable and is supposed to restrict corrosion at the vessel wall in this area. In order to keep expenditures within acceptable limits, it is considered necessary that the process be performed in stainless steel vessels. For this reason and in view of the corrosion problem, the operating temperature is generally limited to a maximum of 950° C. For short periods of time it is possible to attain a temperature of 1100° C. It is proposed, when using sulfate containing waste solutions, to add phosphate, aluminum, calcium, lithium or sodium ions to the waste solution during pretreatment.

A further process, called a continuous pot glass process, employs a specially designed melting crucible as the process vessel from which the finished glass melt flows via an overflow into heated storage vessels. The pretreated waste solution is fed at several points, together with the glass formers, into the cylindrical melting crucible which is horizontally disposed in a furnace. The feeder lines are water cooled in order to prevent evaporation and crust formation in the lines. In this process as well, a calcinate layer is formed from wall to wall, i.e. from the one crucible wall to a partition in the crucible arranged vertically at some distance from the outlet of the melt (overflow) and penetrating into the melt to about one half of the layer of the melt so as to prevent parts of the other layers from reaching the overflow. The throughput quantity of waste solution for this process with a crucible diameter of 500 mm and a length of 1000 mm is supposed to lie at 30 to 45 liters per hour.

In Fontenay-aux-Roses, France, a pot-glass process has been developed which is known as the Piver process. The Piver process also provides discontinuous feeding of the waste solution and of the glass formers which are mixed thereinto shortly before entrance into the process vessel. The Piver process is a discontinuous process even though the glass melt is transferred from the process vessel into storage vessels. The Piver process operates, in contrast to the above described continuous pot glass process, with a vertically disposed process vessel which, similarly to the FINGAL process or the RLG process, is inserted into a furnace which is divided into one or a plurality of heating zones. The waste solution and the glass formers are pretreated in separate systems. The glass formers are added as suspension. The waste solution and the glass former suspension are fed into the pot (process vessel), which has been uniformly preheated to about 500° C., in a uniform manner in dependence on the evaporation energy until a fill level of about 75% of the total volume of the pot has been reached. During the feeding phase, evaporation takes place and the dry residue is calcinated in the lower zones of the process vessel. After the feed has been shut off, the remainder of waste solution and glass former suspension in the pot is evaporated and calcinated. Then the calcinate is melted at about 1250° C. The process cycle for the pot is terminated with the discharge of the melt. Two ruthenium filters filled with iron containing granulate, a condensation and absorption system, a silica gel filter and a system for concentrating the condensate are provided to purify the waste gas. In order to remove the charged fillings of the ruthenium filters, the iron containing granulate is discharged into the process vessel where it is enclosed in the glass melt. A pilot system for the Piver process erected in Marcoule, France, employs a process vessel of 2000 mm length and about 250 mm diameter and has a throughput of waste solution of about 20 liters per hour.

In a nuclear research facility operated by the Kernforschungsanlage Julich GmbH, a process was tested which operates with a borosilicate matrix and comprises five intermediate process steps (in short FIPS). The nitric acid waste solution is passed through the following process steps in the order listed:

(1) denitration of a preconcentrated fission product solution with the addition of formaldehyde in a modified evaporator;

(2) mixing the denitrated solution with the glass formers;

(3) drying the suspension on a roller dryer;

(4) vitrification of the dry residue in an induction heated crucible;

(5) purification of the waste gas with recovery of concentrated nitric acid.

The process is described by M. Laser, St. Halaszovich, E. Merz and D. Thiele in Reaktortagung Dusseldorf, Mar. 20 to Apr.

2, 1976, Deutsches Atomforum e.V. (1976) pages 379–381. Denitration takes place with the addition of formaldehyde at about 90° C. under a pressure of 2000 mm column of water, whereby the free nitric acid decomposes while forming nitric oxides. The denitrated and concentrated fission product solution is mixed with a slurry of the glass formers, namely, a slurry of silicic acid, borax, lime and soda. This is supposed to produce an easily pumpable suspension which is pumped by means of an immersion pump into the roller dryer. The roller dips into the suspension which causes a thin layer to adhere to it. This layer dries during rotation of the roller and is then scraped off by a blade. The result is supposed to be a well trickable powder which drops through a shaft into the melting crucible. The dry powder is melted at 1150° C. to 1200° C. in the same manner as in the RLG process. The nitric oxide containing waste gases from the melting crucible are freed of suspended matter and are combined with the waste gas from the denitration. This is followed by acid recovery from the nitric oxides.

All of these processes have a number of drawbacks. A grave drawback of the processes operating with a process vessel or melting crucible heated in separate zones so that three layers are formed during the course of the process, i.e. a glass melt layer at the bottom of the vessel, a calcinate layer above the glass melt layer, and a liquid or suspension layer still to be evaporated above the calcinate layer, is clearly described in German Offenlegungsschrift No. 22 45 149 in the name of Gelsenberg A.G. In such processes, for example the FINGAL process, the RLG process, the continuous pot glass process or the Piver process, there is supposed to exist the danger than larger quantities of liquid may pass through cavities or cracks in the calcinate layer and reach the hotter zones, evaporate there in an explosive manner, and carry along larger quantities of radioactive solids into the waste gas line and may even damage the melting crucible. Even without an explosive evaporation, the waste gas line is reported to clog frequently if the waste solution is introduced into the center of the crucible. To overcome this danger, the Gelsenberg process disclosed in German Offenlegungsschrift No. 22 45 149 suggests that the evaporation, calcination and melting to form phosphate glass from solutions or suspensions, respectively, of radioactive waste materials be effected along the walls of the melting crucible. The suspension is introduced into the melting vessel in such a manner so that it encounters the wall or already formed calcinate, respectively, in the upper portion of the vessel. The calcinate is disposed only at the wall of the crucible. There it is slowly melted, and drops into the phosphate glass melted disposed in the lower portion of the melting vessel. The suspension which is introduced into the melting vessel is previously concentrated in a separate vessel in the presence of hot phosphoric acid, is denitrated with formaldehyde, and then mixed with a soda solution and boiled, according to the processes disclosed in German Offenlegungsschrift Nos. 22 40 928 2nd 22 40 929. The waste gases produced during the evaporation and vitrification of the thus pretreated fed-in suspension, which gases contain ruthenium, are returned to the liquid phase present in the vessel where the concentration and denitration steps are performed.

In Great Britian, the FINGAL process developed into the HARVEST process which is supposed to permit greater throughputs and does without the two ruthenium filters. In experiments according to the HARVEST process which have thus far been performed only with simulated fission products, it has been found that if the introduction conditions of the phosphate glass process of Gelsenberg are transferred to the HARVEST process which operates with borosilicate glass so that there is an introduction of the suspension along the process vessel walls, it is possible to reduce the carrying along of certain species of the simulated fission products with the waste gas from 2.5 percent by weight by 0.1 percent. See, J. B. Morris, B. E. Chidley: International Symposium on the Management of Radioactive Wastes from the Nuclear Fuel Cycle, Vienna, Mar. 22–26, 1976 (Paper IAEA/SM/207/22).

In addition to the above, the known processes have further significant drawbacks which include the relatively small throughput of waste solution in the processes operating with discontinuous introduction, such as, for example, the FINGAL process, the RLG process or the Piver process, and the resulting high operating time per unit volume of the solidification product. Further, high expenditures are required for systems to perform the process, particularly that part of the process which occurs before introduction of the solutions into the respective process vessels, e.g. for pretreatment in the FINGAL, RLG, continuous pot glass and Piver processes, and for possible denitration of the waste solutions in the FIPS process and Gelsenberg process. Moreover, the apparatus is complex and expensive, including the high temperature furnaces which are divided into a plurality of separate heating zones with the associated relatively complicated heating programs. High costs further result from the fact that the relatively expensive process vessels are used as so-called lost storage vessels. Finally, the pumps which convey the suspensions into the process vessels or melting crucibles, respectively, are susceptible to malfunction.

SUMMARY OF THE PRESENT INVENTION

It is therefore a primary object of the present invention to provide a process which avoids the drawbacks of the prior art processes and, in spite of a greatly simplified process sequence, assures security against uncontrollable reactions with the lowest possible expenditures of labor, space, volume and funds.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects and in accordance with its purpose, the present invention provides a method for the solidification, in a manner which protects the environment against contamination, of waste materials obtained during reprocessing of irradiated nuclear fuel and/or breeder materials in a matrix of borosilicate glass, in which highly radioactive solutions or slurries containing the waste materials in dissolved or suspended form are evaporated in a vessel in the presence of glass former substances until they are dry, the dry residue is calcinated and the calcinate is melted together with the glass formers while waste gases are discharged to the environment, comprising: introducing, in a controlled and continuous manner, a waste liquid which has been obtained from a reprocessing system without pretreatment and which has been mixed with glass formers and a reduction agent, into the center of a borosilicate glass melt disposed in a melting crucible at a temperature in the region of 1000° to 1400° C. to form an island-like drying and calcinating zone (island zone) on the surface of the melt while avoiding contact of the waste liquid with the walls of the crucible, to form a reducing atmosphere, and to avoid the presence of components in the waste gases which would radiologically and/or chemically contaminate the environment.

In a preferred embodiment of the present invention, a concentration maximum of the reduction agent is formed continuously in the gaseous phase in the region of the island zone, with a concentration gradient in the reducing atmosphere which decreases with increasing radial distance from this maximum. In a further embodiment of the present invention, a positive heat input is provided which rapidly penetrates the melt radially from the outside toward the center because of the temperature radiation of the heated walls. Advantageously the reduction agent used in the present invention is formic acid.

It is to be understood that both the foregoing general description and the following detailed description are exemplary, but are not restrictive of the invention.

DETAILED DESCRIPTION OF THE INVENTION

In the practice of the present invention, the waste liquid which has been mixed with glass formers and reduction agent is continuously dispensed in measured quantities into the island zone, preferably at a throughput in the range of about 10 liters per hour to about 150 liters per hour.

The continuous introduction in the present invention of suspensions containing waste solution and glass formers permits relatively high throughputs of these suspensions, under consideration of sensible diameter sizes of commercially available melting crucibles, which throughputs could otherwise possibly be attained only by combining a rotating pipe calciner with a melting furnace. Controlled introduction in the present invention is understood to mean that the waste solution is mixed with glass formers depending on the amount of solids the waste solution contains according to earlier determinations, and is dispensed into the melting crucible in measured quantities at a uniform rate, without demixing, and at a constant mixing ratio with respect to the glass formers. Shortly before the mixture enters the melting crucible, it is brought together with the reduction agent and mixed with it.

One of the numerous advantages of the process according to the present invention compared to the processes constituting the state of the art, is that in the present invention the waste solution which is taken from the reprocessing system in a preconcentrated form is mixed with the glass formers without pretreatment and is fed into a storage vessel from which the mixture (or suspension, respectively) is conveyed into the melting crucible. In contrast thereto, in numerous prior art processes, such as, for example, in the FINGAL process, the glass formers must be processed with nitric acid to constitute a conveyable suspension because they are transported separately from the waste liquid until they are mixed with the waste solution only shortly before entrance into the process vessel. In the normal case, the highly radioactive waste liquids coming from a reprocessing facility already contain nitric acid and/or nitrates.

The feeding of the suspension into the center of the borosilicate glass melt while avoiding contact of the waste liquid with the crucible walls in accordance with the present invention has the great advantage that the steady or uninterrupted introduction of the suspension, which introduction is adapted to the evaporation output, in the final outcome produces a better throughput and greatly reduces corrosion along the crucible walls since the waste liquid does not contact the walls but only the melt. This results in longer lifetimes for the relatively expensive melting crucibles which, moreover, require only a single heating zone. By feeding the suspension onto a glass melt having a temperature in the range between about 1000° C. to about 1400° C., intake conditions can remain practically the same, mixing is improved, and time consumption is reduced.

In the present invention, the mixing of the reduction agent into the suspension shortly before feeding it into the melting crucible and the then resulting reducing atmosphere which forms above the island zone have the effect that the ruthenium which is contained in the waste solution, mainly as nitrosylruthenium nitrate, is incorporated in elemental form almost completely (>99%) and directly, i.e. without a detour over ruthenium filters or waste gas return, into the solidification product. The use of formic acid as the reduction agent produces only relatively small amounts of nitric oxides, so that neither an absorber for $NO_2$ alone nor an NO oxidation device with connected absorber for the recovery of nitric acid is required or desirable for economic operation.

The expanse of the island zone on the surface of the glass melt may lie within a region extending from a lower value defined by a throughput which is barely of commercial interest to a maximum of about two thirds of the melt surface. The addition of, for example, a 98% formic acid to the suspension before the latter is introduced into the melting crucible depends on the nitrate ion concentration in the waste solution which has earlier been determined by way of analysis. Two or three times the stoichiometrically required quantity of formic acid is sufficient for the desired reduction reactions and for the reducing atmosphere above the island zone and results in less stress on the waste gas filters. It has been found that, compared to the prior art processes, only a small quantity of relatively clean waste gases are produced by practice of the present invention so that a costly waste gas purification system, as it is required, for example, for the FINGAL process or the RLG process, can be eliminated.

Preferably, the suspension is added to the melt with the aid of an airlift conveying device which is a well known device in technical applications. An airlift conveying device has been found to be more dependable than a pump since the air lift operates in the manner of a water jet pump, except with air instead of water, and thus has no moving parts. The use of an airlift conveying device eliminates the otherwise possibly required replacement of a pump which is brought about by malfunction of the pump, there is no secondary waste from a contaminated pump, and there is no danger of radiation contamination of the operating personnel during changing of pumps.

The airlift conveying device is connected, contrary to its normal use, so that the pipe with the larger diameter, which during regular use serves as the liquid reservoir, is used as the discharge pipe for the suspension. This has the advantage that the airlift permits uniform dispensing in measured quantities of the suspension into the melting crucible and there is no interference in the form of gas bubbles in the discharge pipe.

The present invention will now be explained with the aid of an example which, however, is not to be construed as a limitation thereof.

EXAMPLE 1

In a recipient vessel of about 2 $m^3$, finely ground borosilicate glass frit ($<200\mu$) was added as the glass former substance to a simulated highly radioactive fission product solution. The resulting suspension was continuously mixed by means of a pulsating column operating at a pulse repetition frequency of about 16 to 18 pulses per minute, thus preventing the deposit of solids. The pulsating column had a diameter of 200 mm, a height of 870 mm and was filled with 350 liters which were pulsed at an amplitude of 13 mm. The mixed suspension was transported and introduced into a glass melting trough via an airlift conveying device. The suspension was mixed with formic acid immediately before being introduced into the melt at a quantity ratio of suspension to formic acid which corresponded to a mole ratio of nitrate ions to HCOOH of 1:1.2 to 2.5. The throughput of suspension plus HCOOH added to the melt was 20 liters per hours, with an accuracy of $\pm 5\%$. The addition of the suspension to the melt occurred continuously into the center of the melting bath, either through an atomizer nozzle or through an inlet pipe. The solution, which had already been predryed by evaporation during its introduction into the melting crucible, formed an island-like drying or calcinate coating on the melt. The calcinate coating was continously melted into the melt at about 1150° C. Through a preheated discharge disposed at the side of the bottom of the melting trough, about 50 kg of glass melt were filled into an ingot mold disposed on a mount once every eight hours via an electrically heated plug. Then, the ingot mold was subjected to controlled cooling of about 5° to 10° C. per hour in a normalizing system. The continuous introduction of the suspension to the melt was maintained for more than 1000 hours. This was the first time in this field that a solidification system was operated in a long-term experiment for more than 1000 hours.

The ratio of the dried solids of the liquid waste to the glass formers is 1:4 in weight. The glass formers are added in the form of fine powdered premelted glass frit. A typical composition of the glass frit is as follows: 51.8 wt.-% $SiO_2$, 21.5 wt.-% $Na_2O$, 1.3 wt.-% $Al_2O_3$, 8.8 wt.-% $TiO_2$, 2.6 wt.-% CaO, 14.0 wt.-% $B_2O_3$.

It will be understood that the above description of the present invention is susceptible to various modifications, changes and adaptations, and the same are intended to be comprehended within the meaning and range of equivalents of the appended claims.

What is claimed is:

1. Method for the solidification, in a manner which protects the environment against contamination, of waste materials obtained during reprocessing of irradiated nuclear fuel and/or breeder materials in a matrix of borosilicate glass comprising; introducing, in a controlled and continuous manner, a waste liquid which has been obtained from a reprocessing system without pretreatment and which has been mixed with glass formers and a reduction agent, into the center of a borosilicate glass melt disposed in a melting crucible at a temperature in the region of 1000° to 1400° C. to form an island drying and calcinating zone on the surface of the melt while avoiding contact of the waste liquid with the walls of the crucible, to form a reducing atmosphere, and to substantially avoid the presence of components in resulting waste gases which would radiologically and/or chemically contaminate the environment.

2. Process as defined in claim 1, wherein a concentration maximum of the reduction agent is formed in the region of the island zone, with a concentration gradient which decreases with increasing distance from this maximum.

3. Process as defined in claim 1, wherein a positive heat intake is provided which rapidly radially penetrates the melt from the outside toward the center.

4. Process as defined in claim 1, wherein the reduction agent is formic acid.

5. Process as defined in claim 1, wherein the waste liquid which has been mixed with glass former and reduction agent is continuously dispensed in metered quantities into the island zone at a throughput in the range between about 10 liters per hour to about 150 liters per hour.

6. Process as defined in claim 5, wherein an airlift conveying device is used to dispense the waste liquid into the island zone.

7. Method for the solidification, in a manner which protects the environment against contamination, of waste materials obtained during reprocessing of irradiated nuclear fuel and/or breeder materials in a matrix of borosilicate glass, comprising:

(a) mixing a waste liquid which has been obtained from a reprocessing system without pretreatment with glass formers and formic acid to reduce nitric acid and nitrate ions present in said waste liquid, the amount of said formic acid being equal to two to three times the stoichiometrically required amount;

(b) introducing the mixture obtained from step (a) in an amount between 10 l/h to about 150 l/h with the aid of air or another gas, into the center of a borosilicate glass melt disposed in a melting crucible at a temperature in the region of 1000° to 1400° C. to form an island drying and calcinating zone extending up to about two-thirds of said melt surface while avoiding contact of the waste liquid with the walls of the crucible, to form a reducing atmosphere, and to substantially avoid the presence of resulting waste gases which would radiologically and/or chemically contaminate the environment.

* * * * *